US006464080B1

(12) United States Patent
Morris et al.

(10) Patent No.: US 6,464,080 B1
(45) **Date of Patent: *Oct. 15, 2002**

(54) CUSHIONING STRUCTURE

(75) Inventors: John Jay Morris, Vestal; Robert Lee Scott, Endicott, both of NY (US)

(73) Assignee: International Business Machines Corporation, Armonk, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/523,668

(22) Filed: Mar. 10, 2000

(51) Int. Cl.[7] ..... B65D 81/02
(52) U.S. Cl. ..... 206/591; 206/453; 206/320
(58) Field of Search ..... 206/586, 591, 206/592, 593, 453, 320; 229/199

(56) References Cited

U.S. PATENT DOCUMENTS 3,049,260 A * 8/1962 Stone ..... 206/586
3,559,866 A 2/1971 Olson, Sr.
3,752,384 A 8/1973 Silburn
3,951,730 A 4/1976 Wennberg et al.
4,120,441 A * 10/1978 Hurley ..... 206/586
4,202,449 A * 5/1980 Bendt ..... 206/453
4,317,517 A 3/1982 Tisdale
4,483,444 A * 11/1984 Gardner ..... 206/594
4,742,916 A * 5/1988 Galea ..... 206/586
4,836,379 A * 6/1989 Shaw ..... 206/523
4,851,286 A 7/1989 Maurice
4,972,954 A * 11/1990 Dickie ..... 206/523
5,062,751 A 11/1991 Liebel
5,069,359 A 12/1991 Liebel
5,267,651 A * 12/1993 Hughes ..... 206/586
5,339,958 A 8/1994 Taravella et al.
5,385,236 A * 1/1995 Cowan et al. ..... 206/453
5,593,039 A * 1/1997 Ortlieb ..... 206/586
5,826,726 A 10/1998 Yang
5,918,800 A * 7/1999 Goshorn et al. ..... 206/586

* cited by examiner

*Primary Examiner*—Shian Luong
(74) *Attorney, Agent, or Firm*—Schmeiser, Olsen & Watts; Lawrence R. Fraley

(57) ABSTRACT

A cushioning structure for placement between an impacting surface and a surface of an object to be cushioned against damage caused by impact during transport, storage, or usage, comprising a spring member having a load bearing portion and spring lead portions, and a restraining member adapted for engaging with the spring leads, to restrain the movement of the spring leads while the cushioning structure is subjected to loading or accelerating or decelerating forces.

19 Claims, 15 Drawing Sheets

CUSHIONING STRUCTURE

TECHNICAL FIELD

This invention relates to cushioning structures such as those used for transportation of articles, e.g., computers, fragile mechanical and optical devices, etc., which protect such articles during such transport and handling associated therewith, and cushioning structures such as those used within an electronic assembly, e.g., liquid crystal display, lap top computer, disk drive, etc., which protect such articles during operation and usage associated therewith.

BACKGROUND OF THE INVENTION

Various methods have been employed to cushion fragile articles, e.g., electronic, optical, electro-mechanical components and equipment, etc., during shipping, storage, and operation. Foamed plastic and various shaped paper fiber spacers and corner elements have been used for shipping fragile articles in containers.

Plastic-based expanded foam, while often serving as an effective cushioning and packing material is, nevertheless, expensive and not environmentally friendly, requiring special disposal after the structure use cycle is completed. Various types and styles of paper cushions are often employed such as padded papers and flat papers that are shaped, corrugated fiber board, and molded paper pulp. These solutions are often low cost and more environmentally friendly. These do not, however provide sufficient resiliency or offer complete protection to relatively delicate articles after repeated and multiple drops, a common situation in the shipping and distribution arenas. These paper cushions often flatten out after multiple drops.

If an article is dropped, it decelerates over a relatively short distance upon impact, resulting in very high forces sufficient possibly to damage a contained article. The purpose of the cushion is, to obviously prevent any damage to the article. Repeated impacts require that the cushioning itself be able to withstand multiple cycles of impact and be able to recover sufficient resiliency to provide continued protection to the article.

Various cushioning members are used to protect comers and surfaces of articles from damage encountered during shipping and handling. Examples of various cushions are described below.

In U.S. Pat. No. 5,826,726, to Yang, there is shown a molded pulp structure for positioning and cushioning an article, comprising a plurality of mold strips having a cushion section formed by a number of successive molded pulp units with each unit defining a ridged surface on the molded pulp.

In U.S. Pat. No. 5,339,958, to Taravella et al., there is shown a two-piece dunnage device which includes a cushioning piece made of plastic foam material and a supporting piece to which the cushioning piece is mechanically attached without adhesives. The cushioning piece has a plurality of cushioning elements that extend from a connecting web. The supporting piece keeps the cushioning piece away from the sides of a shipping container.

In U.S. Pat. No. 5,069,359, to Liebel, there is described an example of packing a round body within a cylindrical paper tube, using triangular shaped corner posts disposed between the outer corrugated box and the cylindrical paper tube.

Another example is in U.S. Pat. No. 4,317,517, to Tisdale, where a load spacer or support is constructed of laminated paper having two trapezoidal shaped hollow load cells, one being "W" shaped, and interconnected by a top sheet or panel having depending flanges on both sides.

U.S. Pat. No. 3,951,730, to Wennberg et al., describes an isolation or packing material structure comprising bellow-like compressible layers interconnected by a zigzag folded strip which is alternately connected to the layers. Additional short projecting parts are positioned between the zigzag strip and the layers to provide support.

In U.S. Pat. No. 3,752,384, to Siburn, there is disclosed a resilient packaging spacer with a plurality of flexible joined triangular shaped elements having a flexible insert for attaching the spacer through a slit in a carton to contain cylindrical or rectangular shaped articles.

Still another example is in U.S. Pat. 5,062,751, to Liebel, where a filler assembly is formed by alternately stacking and laminating "V" shaped and "W" shaped sheets which are glued together along the sides and in the center.

U.S. Pat. No. 3,559,866, to Olson, describes a carton liner fabricated with a flat strip and a triangle shaped paperboard strip having triangular projections.

In yet another example, a plastic foam cushioning element is described in U.S. Pat. No. 4,851,286, to Maurice, wherein a cushion is provided by adhering together two layers of different density foam.

Sonopost (TM) Design Chart product literature from Sonoco Products Company, Hartsville, SC, describes various corner post styles used for protecting the corners or edges of an article.

A cushioning structure which assures maximum protection to the article during shipping, handling, or usage, by lowering the acceleration level when an article is dropped, providing multiple incident cushioning protection, as defined herein below, has hitherto not been provided. To solve this problem, a new and unique cushioning structure, utilizing few parts, has been developed. It is believed that such a cushioning structure will constitute a significant and important advancement in the art.

OBJECTS AND SUMMARIES OF THE INVENTION

It is therefore, and object of the present invention to enhance the art of cushioning structures particularly in the shipping, transporting and operation of articles.

It is another object of the invention to provide a cushioning structure which is integrated within the design of articles.

It is yet another object of the invention to provide a cushioning structure which provides effective and continued shock and vibration protection to an article.

It is still another object of the invention to provide such a cushioning structure which can be produced using fewer parts thereby representing a cost advantage to the ultimate consumer of the package as well as to those who produce it.

According to one aspect of the present invention, there is provided a cushioning structure comprising: a spring member including a load bearing portion having a load bearing surface and a plurality of spring lead portions, each of the spring lead portions including a retaining feature and extending from the load bearing portion and adapted for engaging an external surface; and a restraining member adapted for engaging the retaining feature of each of the spring lead portions, the restraining member flexibly restraining the spring lead portions when a load is applied to the load bearing surface of the load bearing portion of the spring member, the spring lead portions moving in a direction substantially away from the load bearing portion of the spring member when the load is applied, while the spring lead portions engage the external surface.

According to another aspect of the present invention, there is provided an electronic assembly comprising: an electronic device; a base member; and, a cushioning structure, positioned between the electronic device and the base member, the cushioning structure comprising a spring member including a load bearing portion having a load bearing surface and a plurality of spring lead portions, each of the spring lead portions including a retaining feature and extending from the load bearing portion of the spring member and adapted for engaging the base member; and a restraining member adapted for engaging the retaining feature of each of the spring lead portions, the restraining member flexibly restraining the spring lead portions when a load applied by the electronic device is transmitted to the load bearing surface of the load bearing portion of the spring member, the spring lead portions moving in a direction substantially away from the load bearing portion of the spring member when the load is applied, while the spring lead portions engage the base member.

BRIEF DESCRIPTION OF THE DRAWINGS

Various embodiments of the invention will be described in detail by way of examples, with reference to the accompanying figures, where.

DESCRIPTION OF THE PREFERRED EMBODIMENT

For a better understanding of the present invention, together with other and further objects, advantages and capabilities thereof, reference is made to the following disclosure and appended claims in connection with the above-described drawings.

Figure 1:
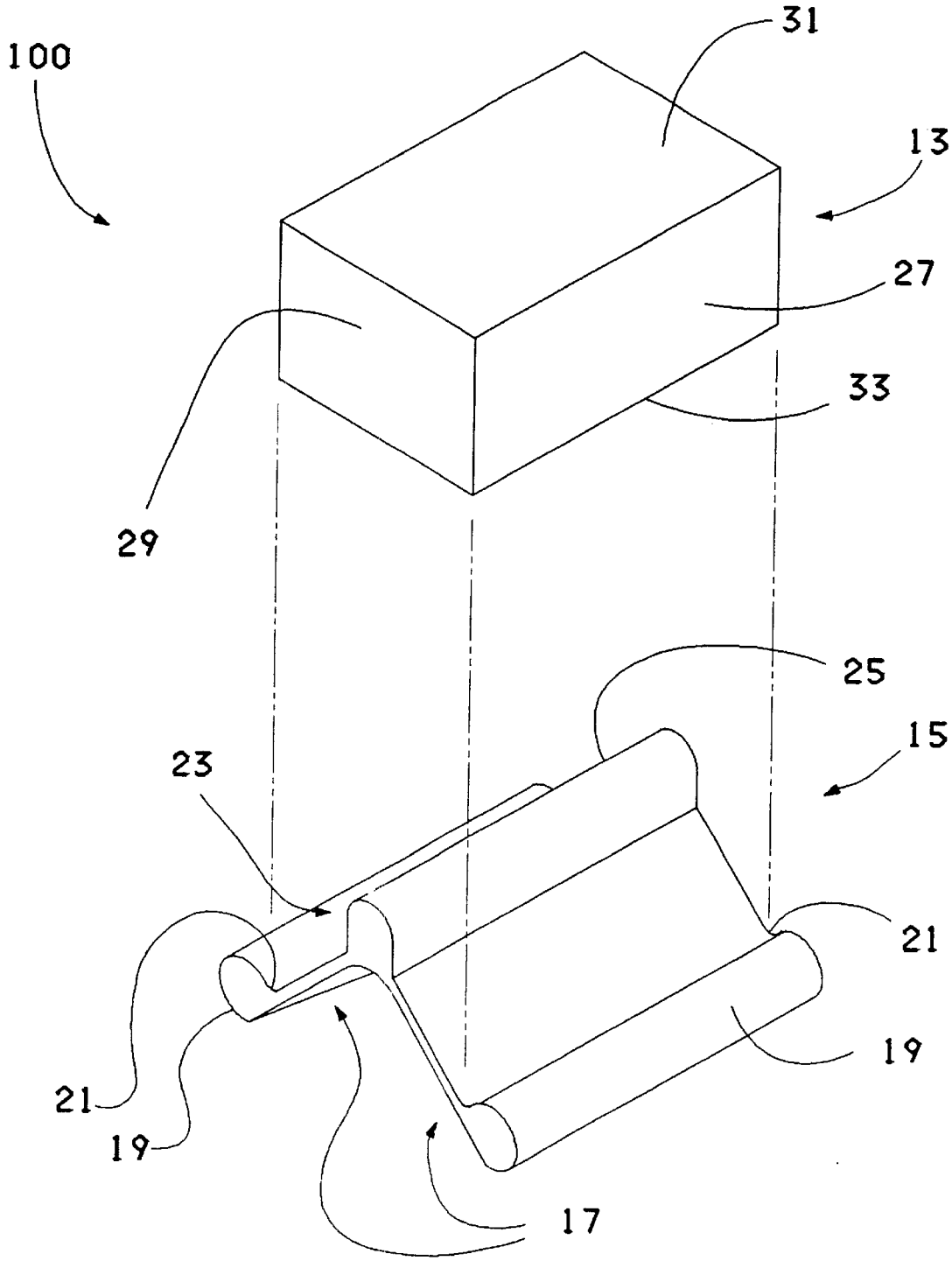
FIG. 1 is a perspective view of the two parts of a cushioning structure of one embodiment of the invention which include a spring member with a load bearing portion and spring lead portions, and a boxlike restraining member which includes a load transmitting wall.

Referring to FIG. 1, there is shown a two-part cushioning structure 100, having a spring member 15, and a restraining member 13. The restraining member is shown here as a five (5) sided box with the lower bottom side of the box open (not shown). The five sided box comprises a load transmitting wall 31, engaging walls 27, and connecting walls 29. The orthogonal boxlike restraining member shown here is a preferred embodiment of the invent ion, but it is understood that other geometries such as, cylindrical, triangular, and irregular shapes are possible variations. The spring member has a load bearing portion 23 having a load bearing surface 25, and spring lead portions 17 which extend outwardly from the load bearing portion 23. Elongated ribs 19, are disposed near the ends of the spring lead portions 17. The length of the restraining member is slightly larger than the length of the spring member so that the bottom opening of the restraining member has sufficient clearance to fit over the load bearing portion 23 of the spring member to allow the engaging wall edges 33 of the engaging walls 27 to engage with the spring lead portions, along the retaining features 21, formed along the elongated ribs 19 situated at the ends of the spring lead portions. Another variation of cushioning structure 100 is a spring member which is equal to or longer than the length of the restraining member. In this case connecting wall 29 could be eliminated, leaving at least two engaging walls 27 and one load transmitting wall 31 to form the restraining member.

The load bearing portion 23 of spring member 15 is shown here as an elongated rib with a domed shape. The load bearing can be hollow or solid and the shape can be adjusted to meet the demands of the application requirements providing additional cushioning to the overall cushioning structure when a load is applied to the load bearing surface. The load transmitting wall is shown as a flat surface connecting to the engaging walls 27, but it is understood that the transmitting wall may have a contoured shape depending on the needs of the application.

Figure 2:
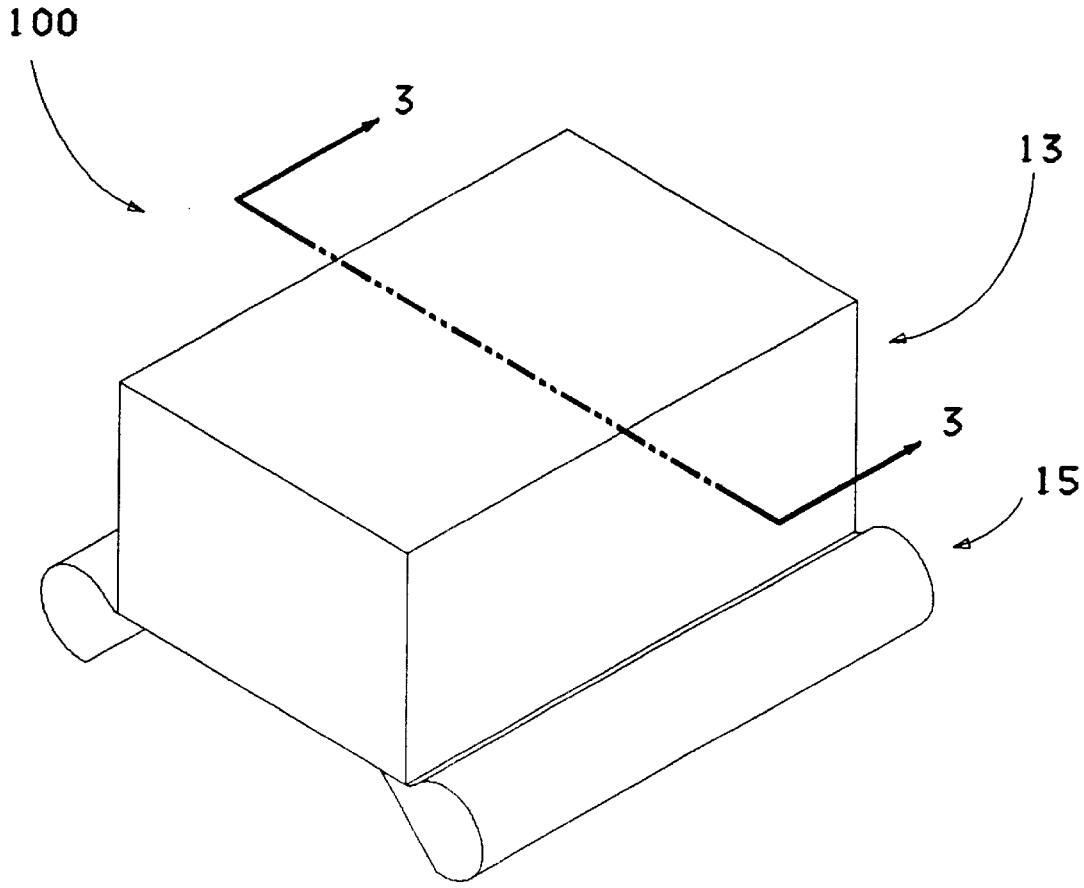
FIG. 2 is a perspective view of the cushioning structure of FIG. 1 with the boxlike restraining member engaged with the spring member.

In FIG. 2, the cushioning structure 100 is shown with restraining member 13 positioned over and engaged with the spring member 15.

Figure 3A:
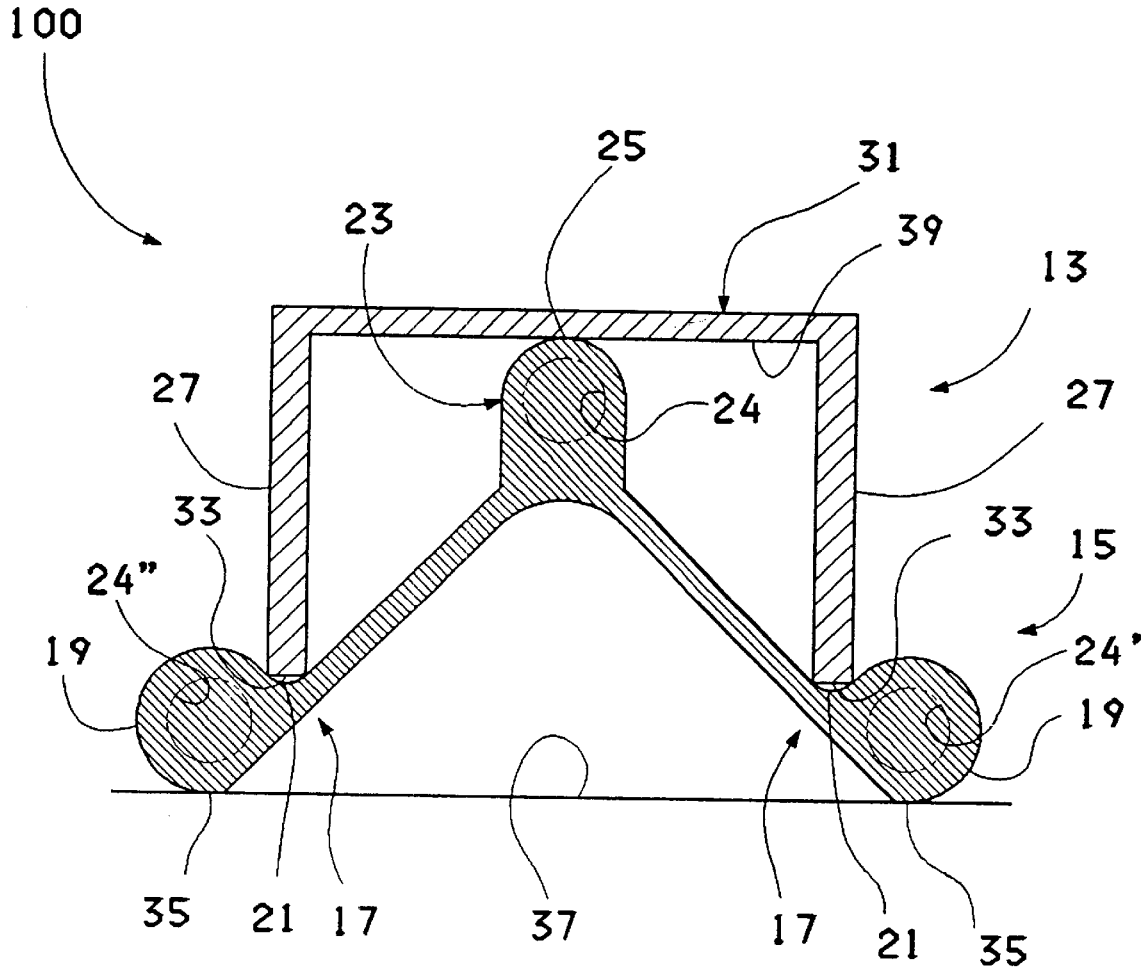
FIG. 3A shows a cross section view of the cushioning structure shown in FIG. 2.

A cross section taken through line 3—3 in FIG. 2 is viewed in FIG. 3A. The spring lead portions 17 of the spring member contact an external surface 37 at contact points 35. One example of an external surface is the inside surface of a card board box used for shipping an article.

The restraining member has engaging walls 27 and a load transmitting wall 31. The engaging wall edges 33, of engaging walls 27, engage or seat at retaining features 21 formed along the edge of elongated ribs 19, near the end of spring lead portions 17. According to a preferred embodiment of the present invention, the underside surface 39 of load transmitting wall 31 is shown in contact with load bearing surface 25, of load bearing portion 23 of spring member 15. In this case restraining member 13 makes three (3) point contact with spring member 15 at the two retaining features 21, and load bearing surface 25. A gap may be present (not shown) between the spring member's load bearing surface 25 and the underside surface 39 of the restraining member's load transmitting wall 31. Formation of a gap depends on the length of the restraining member's engaging walls 27, the length of spring lead portions 17, the angle of the spring lead portion relative to the load bearing portion 23, and the angle of the restraining member's engaging walls 27 relative to load transmitting wall 31. In such situations, where a gap is present, contact points would initially be made between restraining member 13 and spring member 15 at the retaining features 21.

The restraining member restrains the movement of the spring lead portions 17 of spring member 15. The restraining member prevents the spring lead portions from spreading apart too far and extending beyond the. yield point of the spring member upon the application of a load. A load may be applied directly to restraining member 13 or to spring member 15. The load transmitting wall 31 has a surface which distributes a load over the restraining member. The restraining member engaging walls 27 absorb shock and provide vibration dampening. The spring member provides a spring response to an application of a load to load transmitting wall 31, external surface 37, or some combination of both. For purposes of illustration, FIG. 3A shows the spring member positioned below the restraining member. It is understood by those skilled in the art that the invention can be positioned in any orientation. For example, the cushioning structure can be inverted so that the load transmitting wall is in contact with an external surface 37, e.g., the interior of a shipping container, and the spring lead portions of the spring member are in contact with an article requiring cushioning protection.

The spring member and restraining member can be adjusted or tuned to the demands of the application requirements. Various characteristics can be changed, e.g., materials, "box geometry", wall thickness, spring lead length, spring lead portion shape, spring lead bend angle, load bearing portion thickness, load bearing portion geometry, hollow spring member, solid spring member, etc. Examples of some materials which the spring member and restraining member can be made from are: shaped fibrous materials such as paper pulp fiber and paper fiber board, plastic, rubber, elastomer, and metals. The preferred embodiment for shipping and transport applications is shaped paper pulp fiber.

Load bearing portion 23 could include a hollow opening 24 (phantom) extending the entire length of the rib or partially along the length. It is also possible to provide similar openings, e.g., 24' and 24" in one or both of the elongated ribs 19. These openings are also shown in phantom in FIG. 3A. Openings 24' and 24" can also extend through or partially within the rib. Elongated ribs 19 may be of various shapes other than that shown in FIG. 3A, e.g., orthogonal, triangular, oval, irregular, etc. The shape would depend on the application. For example, if the surface 37 is very smooth and slippery producing a low coefficient of kinetic friction, it may necessitate increasing the surface area of contact point 35 by changing the shape of the elongated rib 19. Similarly, the load bearing portion 23 although shown in the preferred embodiment as a domed shaped elongated rib, can be made into other shapes, e.g., flat, contoured, triangular, oval, irregular, etc., depending on the application. For example, the shape of the load bearing surface may be made flat to enable a stable engagement with underside surface 39 of load transmitting wall 31. This would be advantageous particularly if engaging walls 27 are shorter than those shown in FIG. 3A, and do not initially make contact with retaining feature 21 prior to imparting a load onto cushioning structure, 13.

Figure 3B:
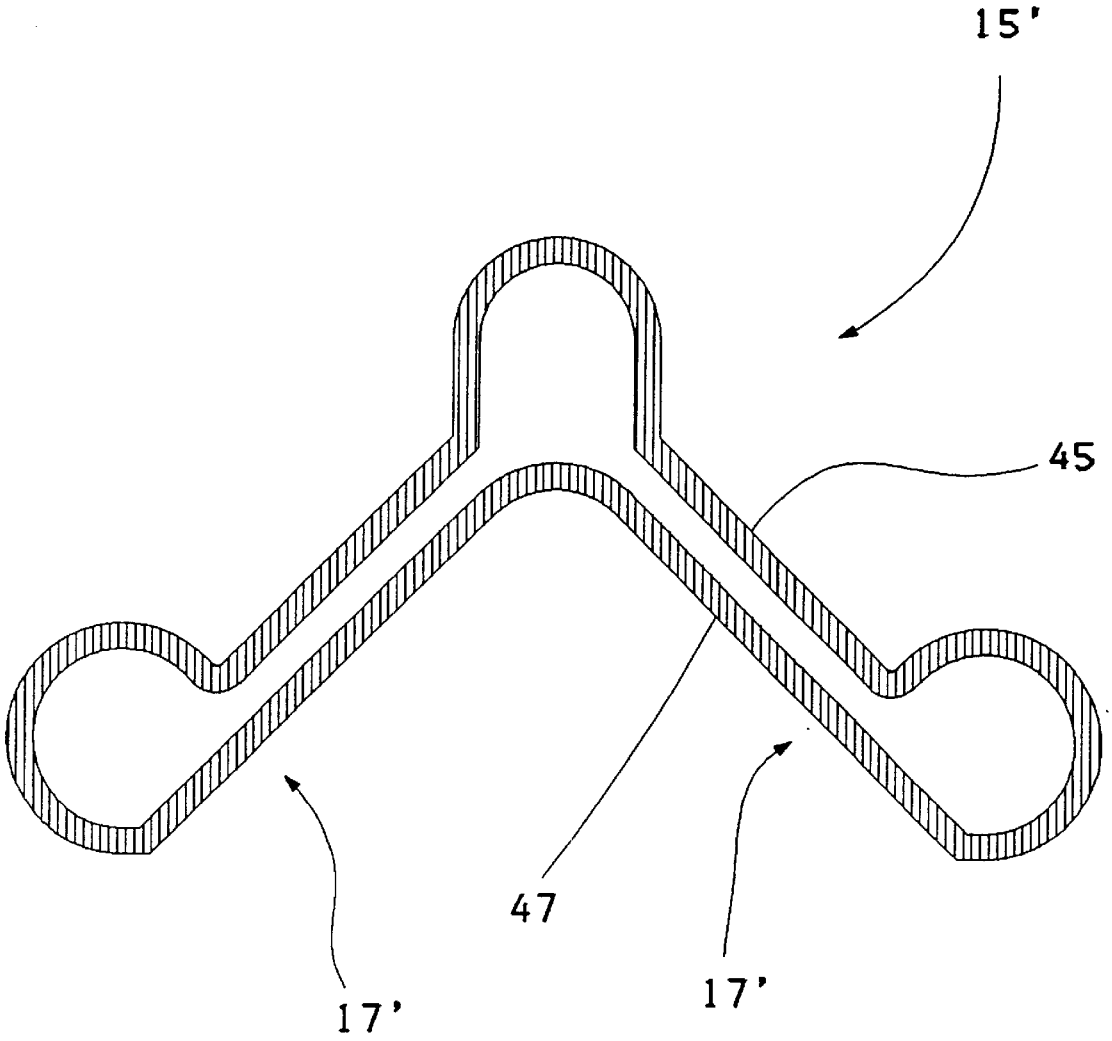
FIG. 3B shows a cross section detail of a spring member which is substantially hollow.

FIG. 3B is a cross section of a spring member 15' of a preferred embodiment of the spring member, shown with a hollow interior and formed by a continuous layer of material. This can be made by extrusion processing of fibrous pulp paper or gluing the ends of a pre-formed layer of material to create a continuous loop. An example of such material is available from Sonopost (TM) Protective Corner Board manufactured by Sonoco, Inc., Hartsville, S.C. Spring lead portions 17' provide a spring response to an application of a force to spring member 15', as these move outwardly away from each other. Additionally, the various folds and bends in the continuous loop, hollow spring members provide an internal spring response to a loading condition. Depending on the stiffness of the material, upper segment 45 may not move in unison with lower segment 47 upon initial loading of spring member 15'. Upon loading, upper segment 45 moves downwards toward lower segment 47. Some initial spring response is provided by the material stiffness of these segments as these absorb some of the forces applied to the spring member. Before or when upper segment 45 contacts lower segment 47, the spring lead portions 17' as a whole, will begin to move apart from each other. In situations where the acceleration forces are large, the spring action provided by these individual segments will have minor contribution. Cushioning would depend primarily on the spring action provided by the spring lead portions and stiffness of engaging walls 27 and connecting walls 29 (shown in FIG. 1.) of restraining member 13. In situations where acceleration forces are small or sizes are miniature, the spring action provided by these individual segments could provide the more significant cushioning response.

Figures 4, 5, 6:
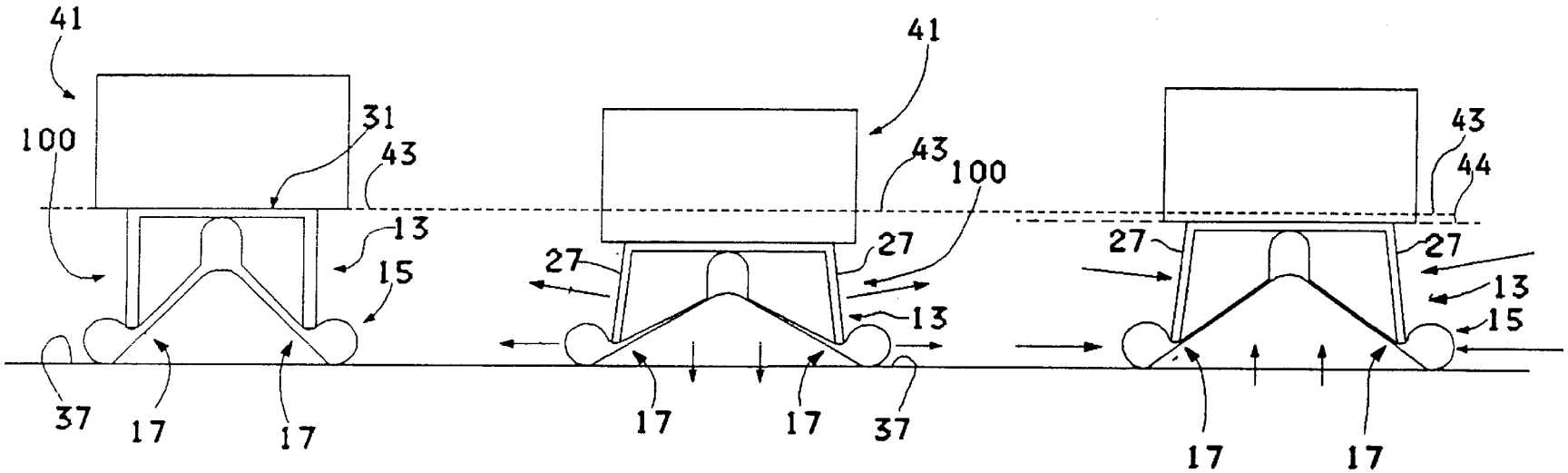
FIG. 4 is a view of the cushioning structure in a state with a load placed on top of the restraining member.
FIG. 5 shows a view of the loaded cushioning structure in a state under application of an impact force.
FIG. 6 shows the cushioning structure in a state, after application of the impact force, where the plurality of spring lead portions and restraining member return the cushioning structure to nearly pre-impact state.

FIG. 4 shows cushioning structure 100, having the restraining member 13 at "three point contact" with spring member 15. A load 41, is positioned on load transmitting wall 31. Spring lead portions 17 contact external surface 37, which in this example is the inner surface of a transport container. For simplification, external surface 37 and load transmitting wall 31 are shown as flat planes but these surfaces can be of any shape. The load 41, eg., article for transport, electronic assembly, is shown supported by cushioning structure 100, at initial rest position 43.

FIG. 5 illustrates the condition where a deceleration force is applied to the load and cushioning structure, such as when the transport container is dropped to a floor. Load 41 moves toward external surface 37, compressing the cushioning structure 100. Upon impact, spring lead portions 17 spread apart, absorbing some of the forces of deceleration. Engaging walls 27 of restraining member 13 move outwardly, along with the spring lead portions, providing additional force absorption. Engaging walls restrain the movement of the spring lead portions preventing the spring lead portions from exceeding the yield point.

After absorbing the deceleration force, engaging walls 27 of restraining member 13, and spring lead portions 17 of the spring member, attempt to recover their original shape and position, as FIG. 6 illustrates. Depending on the forces applied, some permanent deformation may be experienced by the respective members resulting in a final rest position 44, below that of initial rest position 43.

Shock tests were performed on a set of cushioning structures as described in FIG. 1 made of paper fiber board. The cushioning structures were put into a card board shipping box with a 30 pound steel plate placed on top of the cushioning structures. An accelerometer was attached to the steel plate. The dimensions of each cushioning structure were approximately 2¾" high×19" long×5" wide. The card board shipping box was repeatedly dropped from a height of 36 inches at approximately 5 minute intervals. The time domain acceleration level readings on the plate for each drop is recorded in TABLE I.

TABLE I

| Drop Number | Paper Cushioning Structure (gs) |
|---|---|
| 1 | 57.74 |
| 2 | 73.01 |
| 3 | 83.64 |
| 4 | 86.81 |
| 5 | 73.21 |

The data shows that after the second drop, the acceleration levels for the paper board cushioning structure remain relatively consistent, demonstrating very good resiliency.

Figure 7:
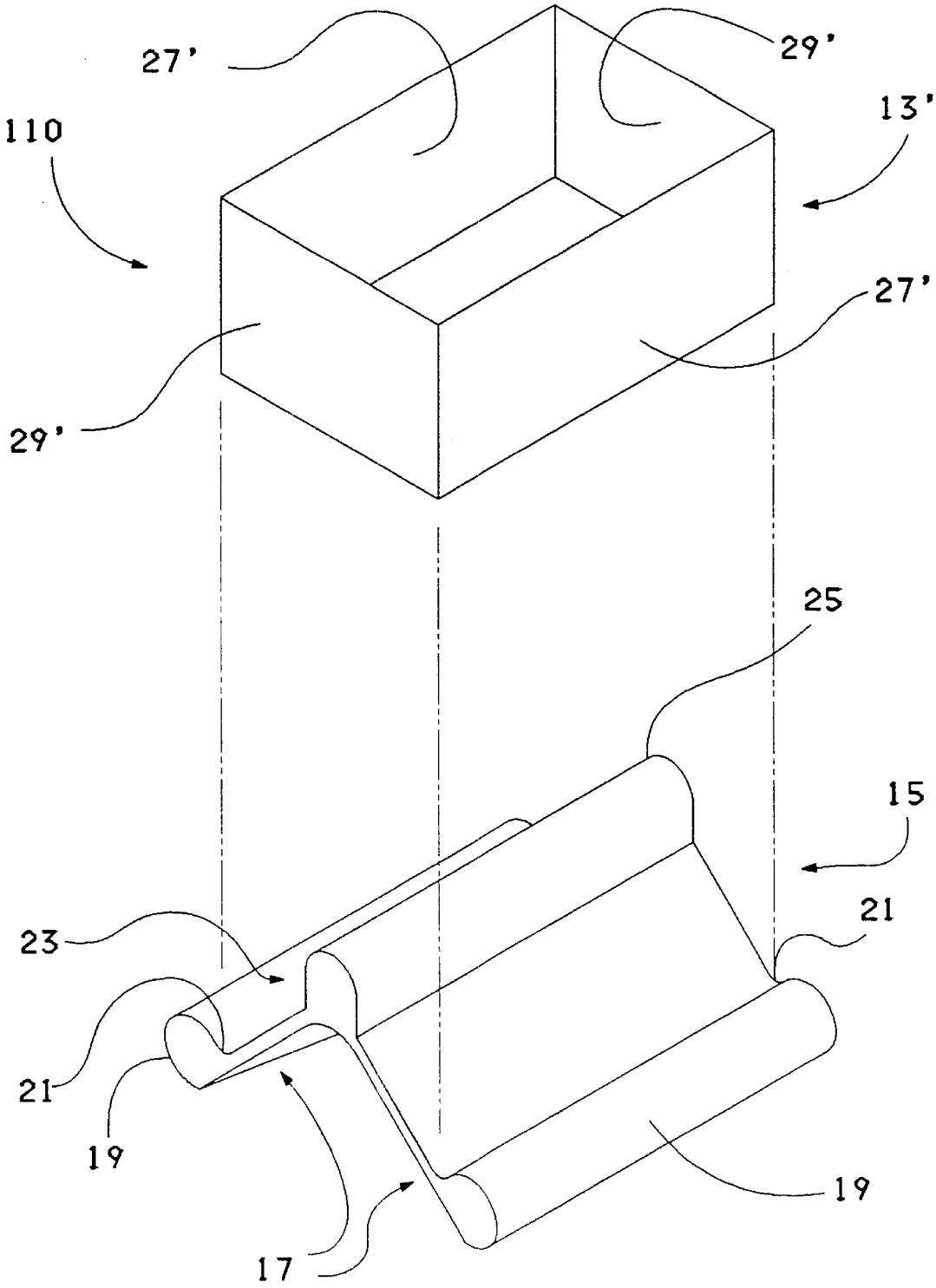
FIG. 7 is a perspective view of a cushioning structure similar to that in FIG. 1 except that the restraining member has no load transmitting wall.

FIG. 7 is another embodiment of the invention which is very similar to the cushioning structure shown in FIG. 1 except that the load transmitting wall 31 of restraining member 13 is not included. If the article that needs to be protected is larger than the periphery of the restraining member 13', and the underside of the article is sufficiently strong to support the body of the article, then a load transmitting wall, as in FIG. 1, may be eliminated. If the article to be protected is smaller than the periphery of the restraining member, then a load transmitting wall would be needed. Similarly, if the article is larger than the span between either engaging walls 27' or connecting walls 29' and if the underside of the article is sufficiently strong to support the body of the article, then a transmitting wall may be eliminated as well.

Figure 8A:
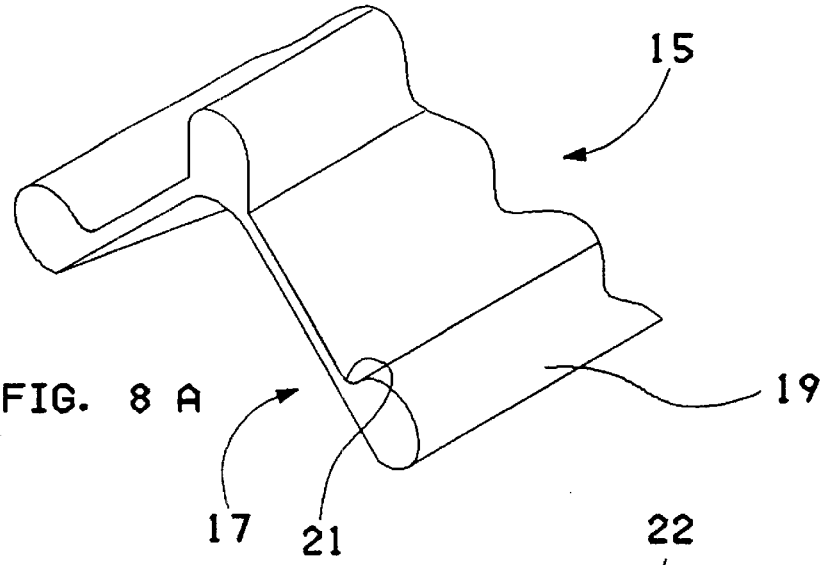
FIGS. 8A–8E show some examples of retaining features on a spring lead portion of a spring member.
Figure 8B:
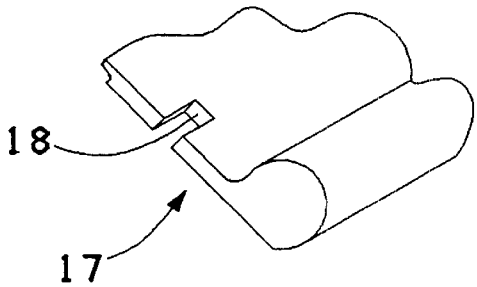
Figure 8C:
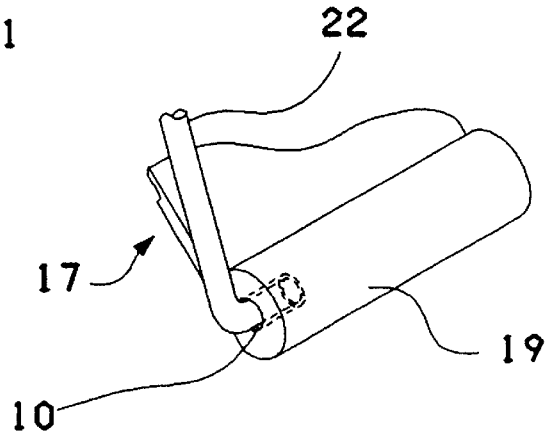
Figure 8D:
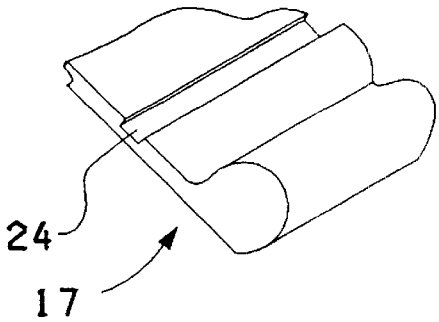
Figure 8E:
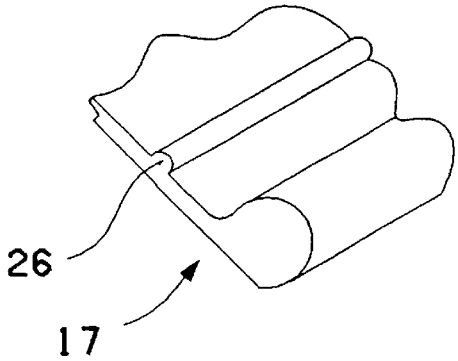

FIGS. 8A–8E show some examples of retaining features which may be employed to engage with various restraining members. FIG. 8A shows a spring member 15 with elongated ribs 19 on the spring lead portions 17. Cusp 21 is an example of a retaining feature which is formed by the geometry of the elongated rib 19. FIG. 8B is an example of retaining feature which is a notch 18 cut out of spring lead portion 17. FIG. 8C shows a hole 10 made in the elongated rib 19 of spring lead portion 17, with the end of a restraining member, a spring clip 22 inserted into the hole. FIG. 8D is yet another example of a retaining feature, in this case, a channel 24, formed in spring lead portion 17. The engaging wall edges of engaging walls and continuous bands are examples of restraining members which would engage with the channel restraining feature. FIG. 8E is an example of a retaining feature which is a projecting upstanding element 26 on spring lead portion 17.

Other examples of retaining features which can be employed to flexibly retain engaging walls of a restraining member, particularly in applications where the direction of loading or force application is cyclical and alternates direction, include, engaging walls with push through snap pegs which pass through holes in the spring lead portions, vertical oriented flexible "C-clamps" which snap over the engaging walls, ball and socket snap fit, adhesives which maintain elasticity, etc.

Figure 9:
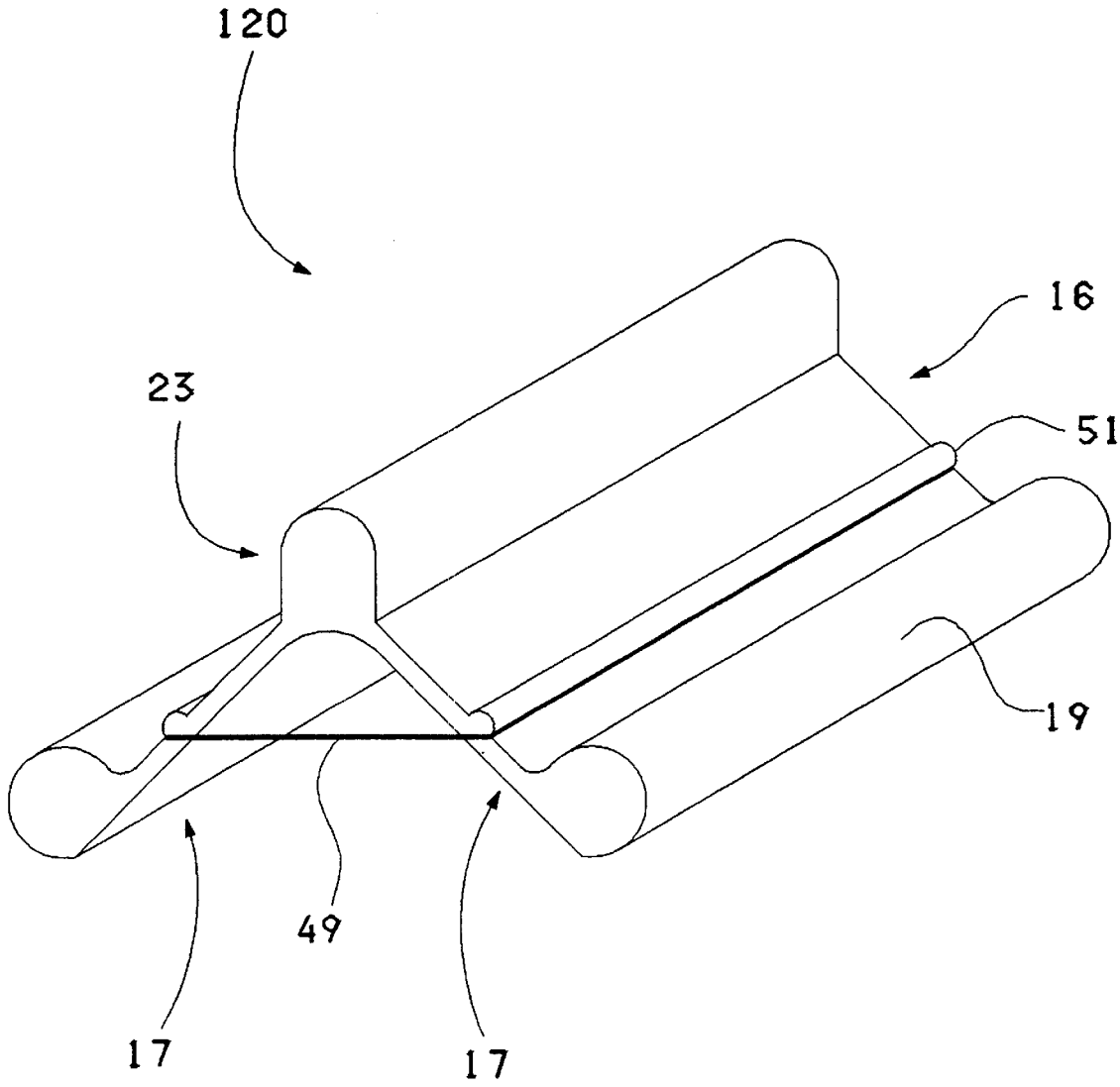
FIG. 9 is a perspective view of another embodiment of the invention wherein the spring lead portions are restrained by a restraining member in the form of a continuous band, engaged with projecting upstanding elements on the spring lead portions of the spring member.

FIG. 9 is another embodiment of the invention wherein cushioning structure 120 has a restraining member 49 which is a continuous band engaging with projecting upstanding element 51, in this case an elongated retaining rib, on spring lead portions 17 of spring member 16. An example of how this embodiment would be used is where two cushioning structures 120 are placed under the base of an article which needs cushioning protection. The continuous band restraining member can be made of a material which is resilient enough to restrain the movement of the spring member preventing the spring member from exceeding the yield point, e.g., elastomers, metals, plastics, rubber, paper pulp fiber, paper fiber board, etc.

Figure 10:
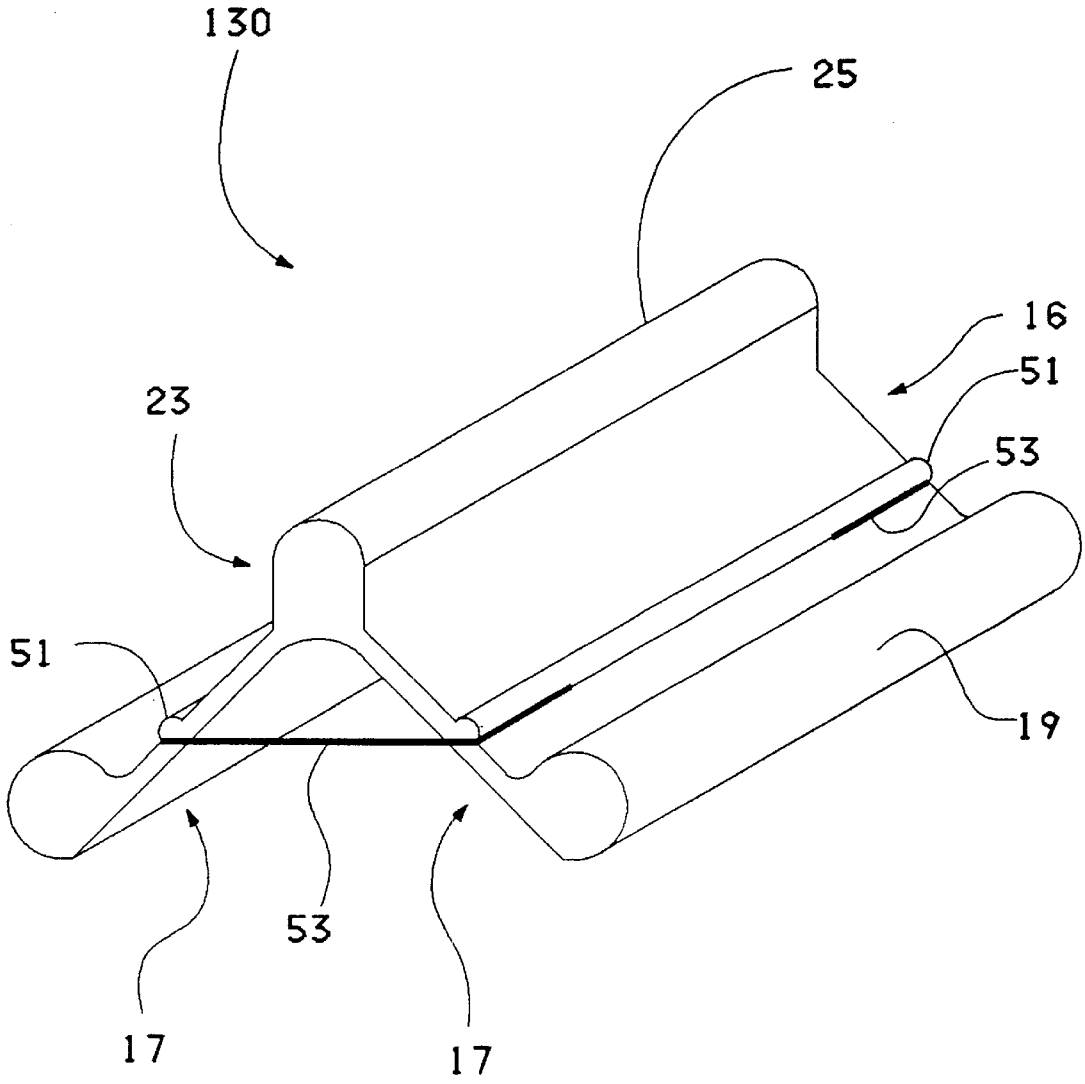
FIG. 10 is yet another embodiment of the invention, similar to FIG. 9 except that the restraining member is a set of spring clips.

FIG. 10 is yet another embodiment of the invention where cushioning structure 130 has spring clip restraining members 53, engaging with projecting upstanding elements 51, e.g., elongated ribs, nubs, etc., on the spring lead portions 17.

Figure 11:
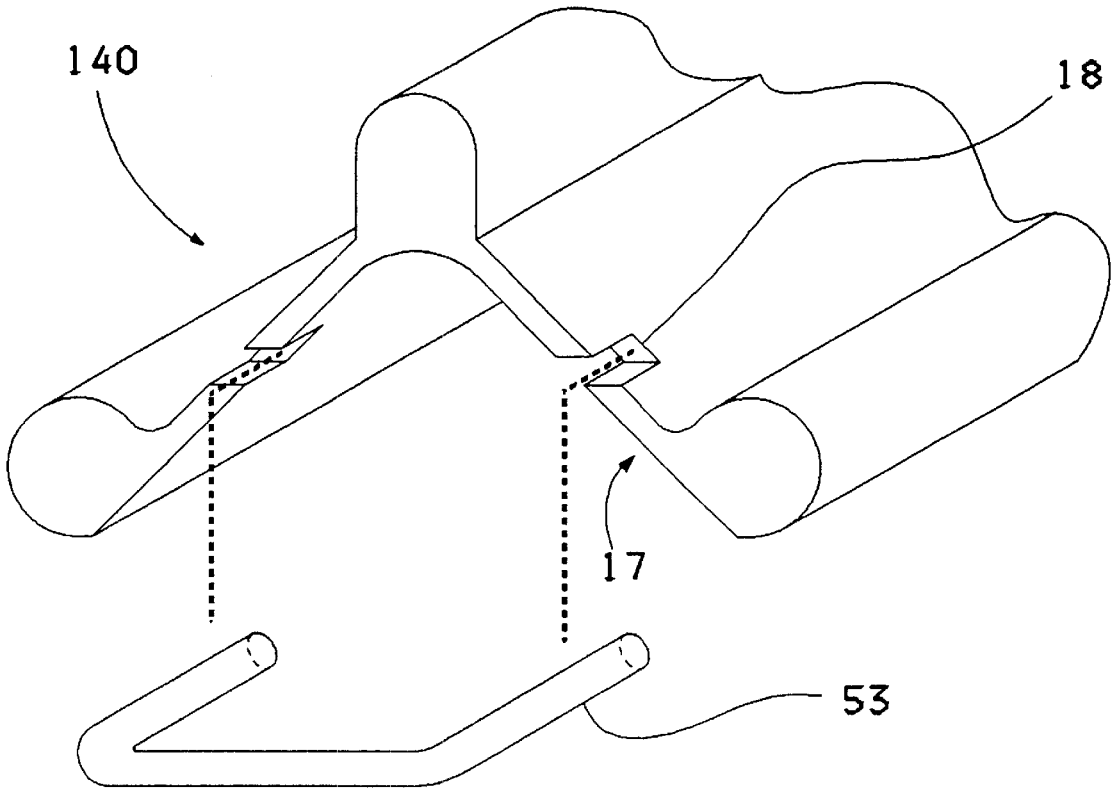
FIG. 11 shows an example where the retaining feature on a spring lead portion is a notch and a spring clip is used as the restraining member.

FIG. 11 shows a cushioning structure 140 having an alternative to the projecting upstanding elements of FIG. 10. In this embodiment, notches 18 are cut into the spring lead portions 17, to enable spring clip 53 (restraining member) to engage with the spring lead portions.

Figure 12:
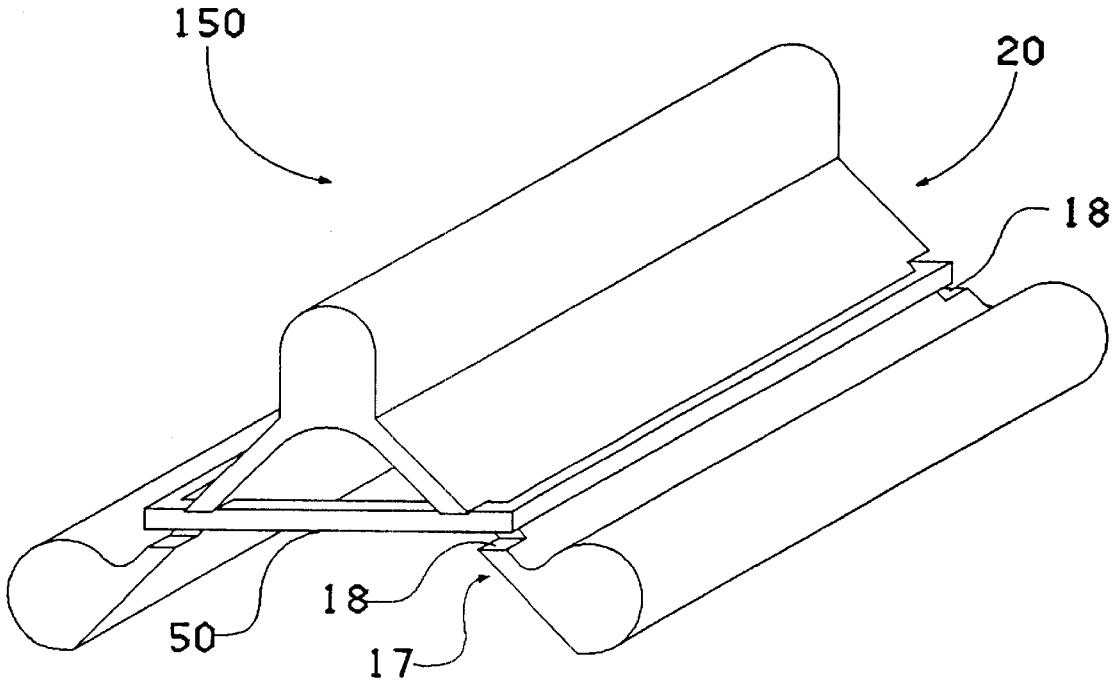
FIG. 12 shows notch retaining features with a continuous band restraining member.

FIG. 12 is another embodiment of a cushioning structure 150 employing the use of notches 18 to engage with a continuous band restraining member 50. Various materials can be used for the continuous band, e.g., rubber, plastic, paper fiber board, paper pulp fiber, metal, elastomer, etc.

Figure 13A:
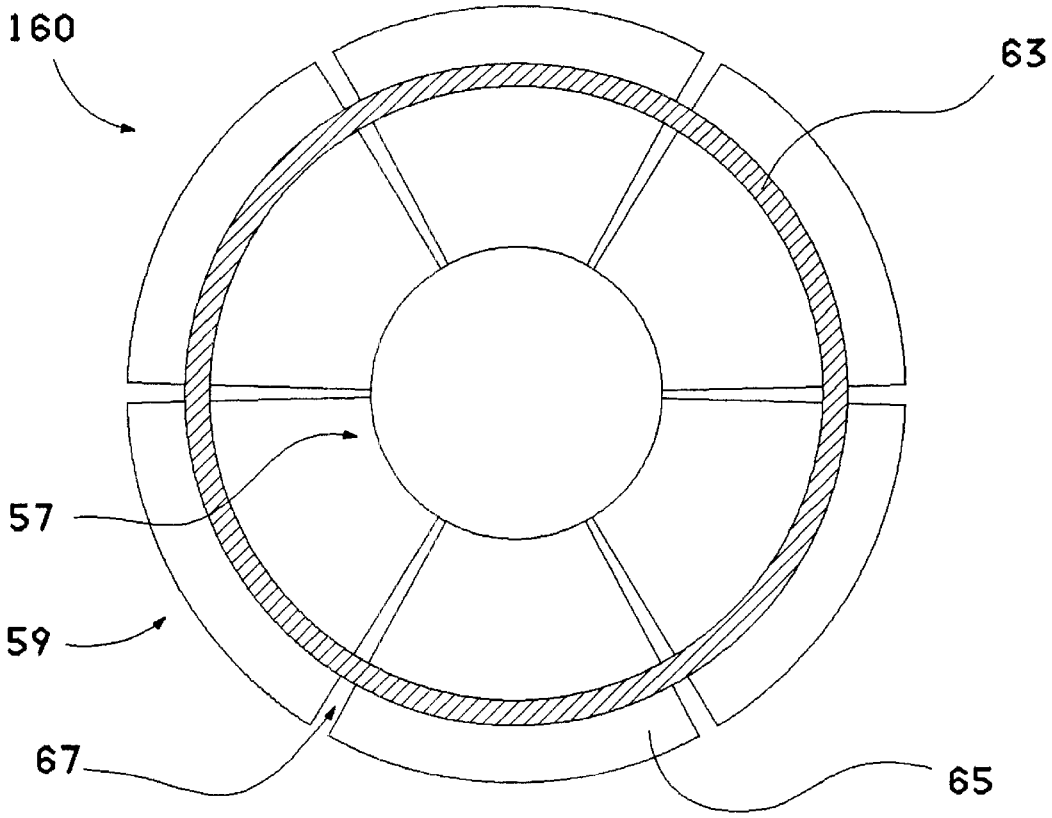
FIG. 13A is a cross sectional view of a cushioning structure with radially positioned spring lead portions and an annular restraining member.
Figure 13B:
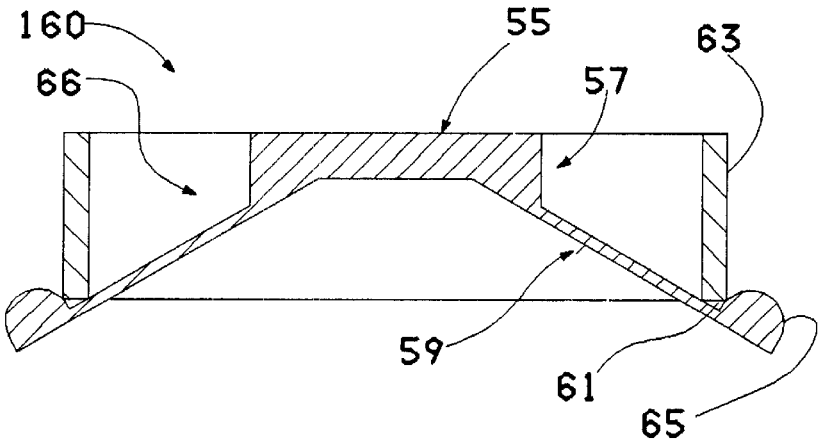
FIG. 13B shows a top view of the cushioning structure of FIG. 13A with the spring member having a load bearing portion which is substantially cylindrically shaped and radially positioned spring lead portions.

FIGS. 13A and 13B show a cushioning structure 160, having a spring member 66 with radially positioned spring lead portions 59 around a substantially cylindrical load bearing portion 57. The spring lead portions 59 have separations 67 which allow the spring lead portions 59 to move outwardly upon application of a load or accelerating force. Load bearing portion 57, has a circular shaped load bearing surface 55. Each spring lead portion 59, is shown with a curvilinear rib 65. The curvilinear rib 65 is an example of a retaining feature which can be used to engage with an annular restraining member 63 along the cusp 61 at each curvilinear rib. This would be the annular version of the orthogonal version of restraining member 13' in FIG. 7. The spring member may be made by various molding or press forming processes depending on material. For example, for a pulp paper fiber spring member, a press forming process could be employed. Because the radial shape is somewhat complicated, the structure could be divided up into pie-like segments for forming and then glued together to complete the radial cushioning structure. An injection molding process could be used for plastic materials. Additional materials can be used to fabricate this radial cushion, e.g., elastomers, metals, plastics, rubber, paper fiber board, etc. The materials may be used in combination or singularly.

Figure 14B:
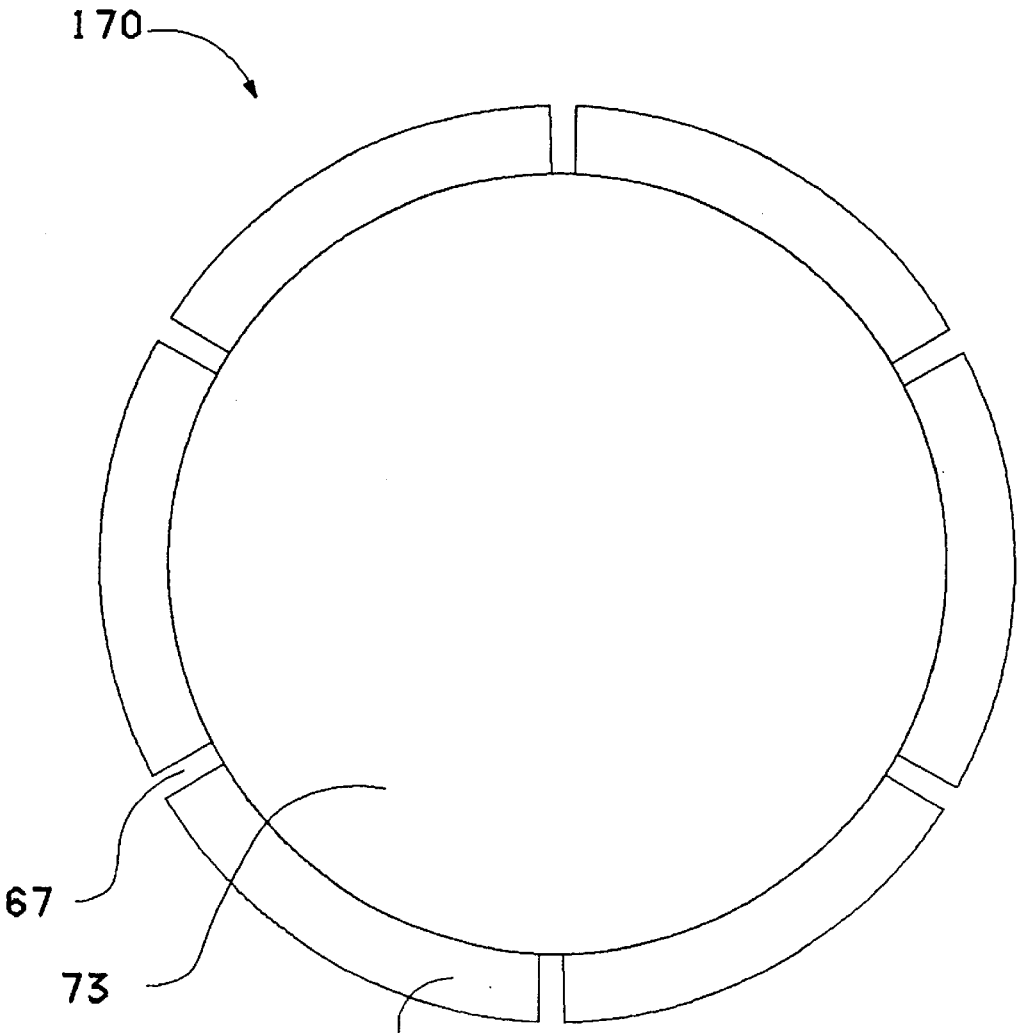
FIG. 14B is a top view of the cushioning structure of FIG. 14A.
Figure 14A:
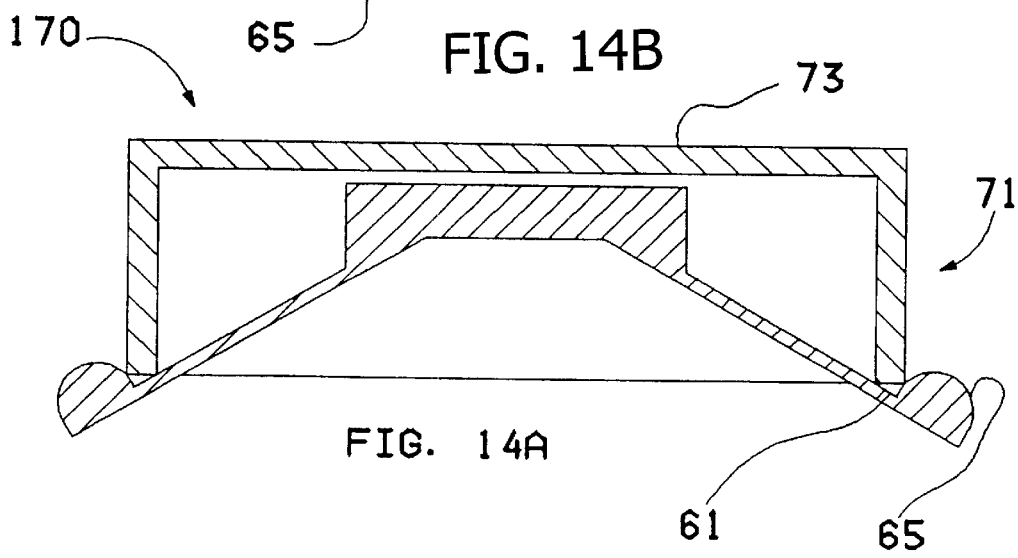
FIG. 14A is a cross sectional view of a cushioning structure having a spring member with a substantially cylindrical load bearing portion and radially positioned spring lead portions engaging with an annular shaped restraining member having a circular load transmitting wall.

FIGS. 14A and 14B are cross sectional and top views of a cushioning structure 170 having a restraining member 71 with a substantially circular shaped load transmitting wall 73. The restraining member is the cylindrical version of the orthogonally shaped restraining member 13 in FIG. 1.

Figure 15B:
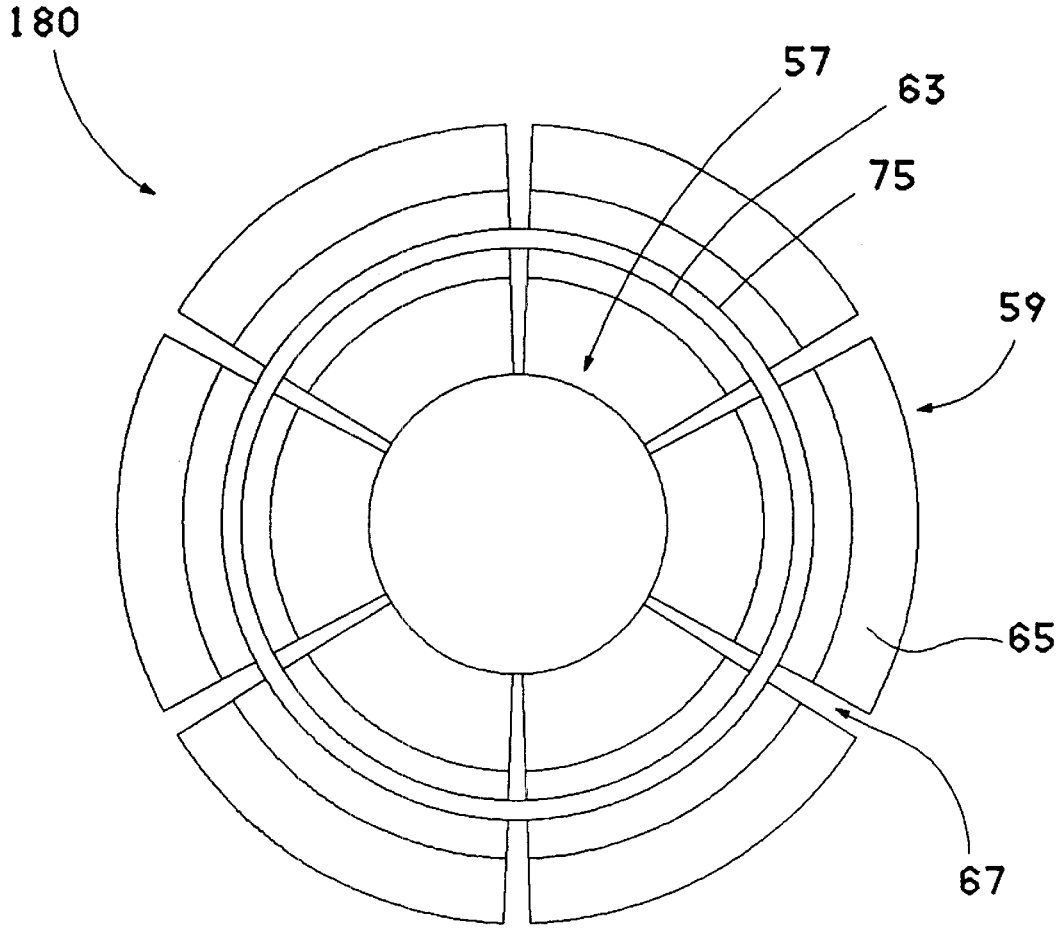
FIG. 15B is a top view of the cushioning structure of FIG. 15A.
Figure 15A:
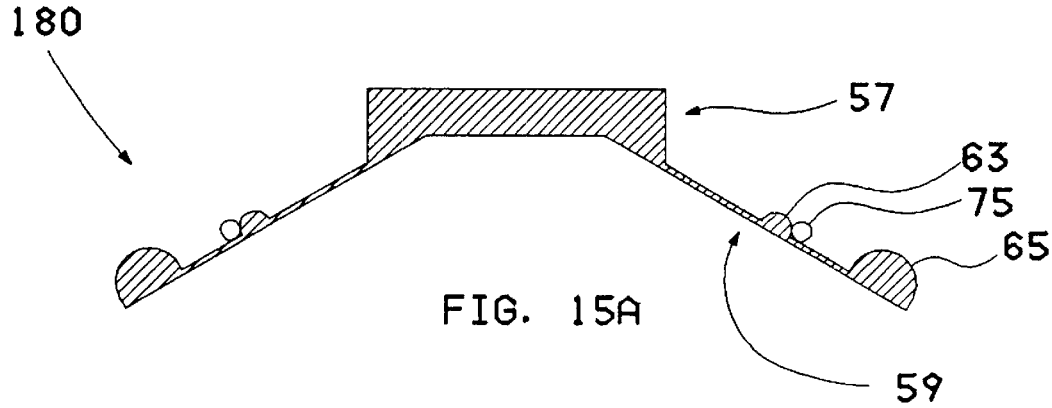
FIG. 15A is a cross sectional view of a cushioning structure having a spring member with a substantially cylindrical load bearing portion, radially positioned spring lead portions, and an annular shaped restraining member engaging with retaining features which are projecting upstanding elements on the spring lead portions.

FIGS. 15A and 15B are cross sectional and top views of a cushioning structure 180 with projecting upstanding elements 63 used to retain restraining member 75. The projecting upstanding elements shown here are curvilinear ribs. The restraining member is shown as a continuous band which is retained by the curvilinear ribs on spring lead portions 59. The projecting upstanding elements could be of various configurations or combinations of configurations, e.g., nubs, buttons, pins, ribs, etc. As seen in 15B, the spring lead portions 59 have separations 67 which allow the spring lead portions to move outwardly. The cushioning structure 180 is the radial version of cushioning structure 120 shown in FIG. 9. Projecting upstanding elements 63 retain a restraining member 75 which in this case is a continuous band of substantially elastic material.

Figure 16:
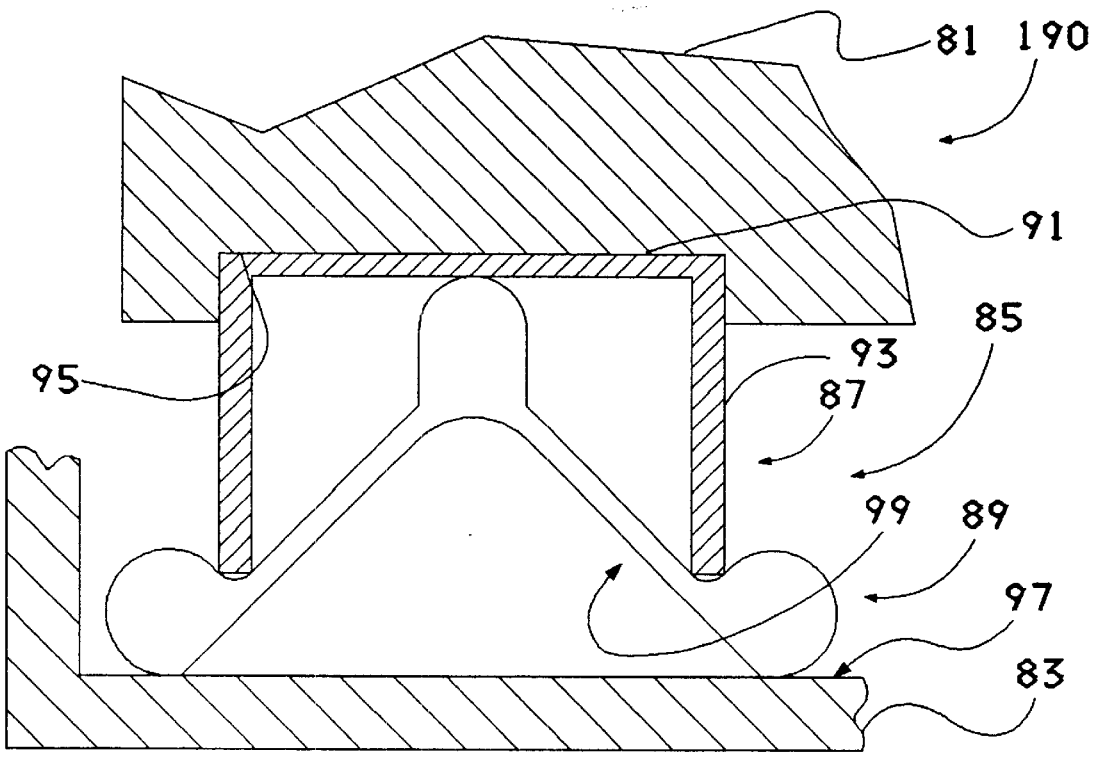
FIG. 16 shows a cross sectional detail of an electronic assembly having a cushioning structure positioned between an electronic device and a base member.

FIG. 16 is a cross sectional view of an electronic assembly 190, having an electronic device 81, a base member 83 and a cushioning structure 85. The cushioning structure 85 is shown here as an integral part of the electronic assembly having a spring member 89 and restraining member 87. Cushioning structure 85 is positioned between the underside 95 of the electronic device 81 and the surface 97 of base member 83. Restraining member 87 has a load transmitting wall 91 and engaging walls 93 to engage with spring member 89. Spring lead portions 99 contact surface 97 of base member 83.

The afore described cushioning structures can be used in protecting an article in a packaging or shipping container. It can also be integrated within the designs of various electronic assemblies, e.g., computers, data storage units, testers, etc., and to isolate fragile parts within the assembly, e.g., lap top computer, liquid crystal display, disk drive, test heads, transducers, etc. The cushioning structure can be built into the base member of an electronic assembly, e.g., housing, protective case, etc., to isolate the electronic device from potentially damaging vibration or impact shock imparted to the base member. The restraining member could be molded into a base member to simplify electronic assembly construction.

While there have been shown and described what are at present considered the preferred embodiments of the invention, it will be obvious to those skilled in the art that various modifications can be made therein without departing from the scope of the invention as defined by the appended claims.

What is claimed is:

1. A cushioning structure comprising:

a spring member including a load bearing portion and a plurality of spring lead portions, each of said spring lead portions including a rib extending from an end of said spring lead portion opposite said load bearing portion and a concave retaining feature at a junction between said spring lead portion and said rib; and a restraining member engaging said retaining feature of each of said spring lead portions, said restraining member flexibly restraining said spring lead portions when a load is applied to said restraining member, said spring lead portions moving in a direction substantially away from said load bearing portion of said spring member when said load is applied, while said spring lead portions engage an external surface.

2. The cushioning structure of claim 1 wherein said rib of each of said spring lead portions is substantially hollow.

3. The cushioning structure of claim 1 wherein said spring member is comprised of a material selected from the group consisting of paper pulp fiber, paper fiber board, plastic, rubber, elastomer, and metal.

4. The cushioning structure of claim 1 wherein said load bearing portion of said spring member comprises an elongated rib.

5. The cushioning structure of claim 4 wherein said elongated rib of said load bearing portion is hollow.

6. The cushioning structure of claim 1 wherein said load bearing portion of said spring member comprises a substantially cylindrical body.

7. The cushioning structure of claim 1 wherein said retaining feature of each of said spring lead portions is an elongated rib, said restraining member adapted for being retained by said elongated rib of each of said spring lead portions when said load is applied.

8. The cushioning structure of claim 1 wherein said restraining member includes a load transmitting wall, said load transmitting wall adapted for engaging said load bearing surface of said spring member.

9. The cushioning structure of claim 8 wherein said restraining member further includes at least two engaging walls extending from said load transmitting wall, each of said engaging walls adapted for engaging said retaining feature of each of said spring lead portions.

10. The cushioning structure of claim 1 wherein said restraining member is comprised of a material selected from the group consisting of paper pulp fiber, paper fiber board, plastic, rubber, elastomer, and metal.

11. An electronic assembly comprising:

an electronic device;

a base member;

a cushioning structure, positioned between said electronic device and said base member, said cushioning structure comprising a spring member including a load bearing portion having a load bearing surface and a plurality of spring lead portions, each of said spring lead portions including a retaining feature and extending from said load bearing portion of said spring member and adapted for engaging said base member; and a restraining member adapted for engaging said retaining feature of each of said spring lead portions, said restraining member flexibly restraining said spring lead portions when a load applied by said electronic device is transmitted to said load bearing surface of said load bearing portion of said spring member, said spring lead portions moving in a direction substantially away from said load bearing portion of said spring member when said load is applied, while said spring lead portions engage said base member.

12. The electronic assembly of claim 11 wherein said electronic device is a liquid crystal display.

13. The electronic assembly of claim 11 wherein said electronic device is a disk drive.

14. The electronic assembly of claim 11 wherein said electronic device is a laptop computer.

15. The electronic assembly of claim 11 wherein said electronic device is a protective case.

16. The electronic assembly of claim 11 wherein said restraining member further includes a load transmitting wall, said load transmitting wall adapted for engaging said load bearing surface of said spring member.

17. A cushioning structure, comprising:

a spring member including a load bearing portion and a plurality of spring lead portions, each of said spring lead portions including a rib extending from an end of said spring lead portions and a concave retaining feature formed between said spring lead portion and said rib; and a restraining member having at least two engaging walls each seated at one of said retaining features of said spring lead portions and a load transmitting surface, wherein said engaging walls flexibly restrain said spring lead portions as said spring lead portions move in a direction substantially away from said load bearing portion of said spring member when a load is applied to said load transmitting surface of said restraining member.

18. The cushioning structure of claim 17, wherein said engaging walls extend from said load transmitting surface.

19. The cushioning structure of claim 17, wherein said load transmitting surface is a surface of said restraining member opposite a surface engaging said load bearing portion of said spring member.

* * * * *